US005100120A

United States Patent [19]

Kikuchi et al.

[11] Patent Number: 5,100,120

[45] Date of Patent: Mar. 31, 1992

[54] CUT-SHEET FEEDER CONTROL METHOD

[75] Inventors: Hiroshi Kikuchi; Jiro Tanuma; Takao Uchida; Akira Nagumo, all of Tokyo, Japan

[73] Assignee: Oki Electric Industry Co., Ltd, Tokyo, Japan

[21] Appl. No.: 499,429

[22] PCT Filed: Oct. 16, 1989

[86] PCT No.: PCT/JP89/01061

§ 371 Date: Jun. 21, 1990

§ 102(e) Date: Jun. 21, 1990

[87] PCT Pub. No.: WO90/04520

PCT Pub. Date: May 3, 1990

[30] Foreign Application Priority Data

Oct. 21, 1988 [JP] Japan ..... 63-264000

[51] Int. Cl.[5] ..... B65H 3/30; B41J 11/58

[52] U.S. Cl. ..... 271/22; 271/110; 271/270; 400/624; 318/696

[58] Field of Search ..... 400/605, 624–628; 101/232; 271/270, 202, 110, 111; 318/685, 696, 599; 355/309, 311, 315, 317, 321

[56] References Cited

U.S. PATENT DOCUMENTS

| | | | |
|---|---|---|---|
| 3,845,850 | 11/1974 | Herr et al. | 101/93.04 |
| 4,015,701 | 4/1977 | Templeton | 271/270 |
| 4,127,800 | 11/1978 | Long et al. | 318/696 |
| 4,519,601 | 5/1985 | Watanabe | 271/270 |
| 4,519,700 | 5/1985 | Barker et al. | 355/315 |
| 4,540,297 | 9/1985 | Imaizumi et al. | 400/625 |
| 4,712,113 | 12/1987 | Brooks et al. | 400/232 |
| 4,778,169 | 10/1988 | Fazio et al. | 271/10 |
| 4,831,461 | 5/1989 | Ohta et al. | 271/270 |
| 4,851,755 | 7/1989 | Fincher | 318/696 |
| 4,897,778 | 1/1990 | Miyamoto et al. | 318/599 |

FOREIGN PATENT DOCUMENTS

| | | |
|---|---|---|
| 56-112892 | 9/1981 | Japan . |
| 58-62658 | 4/1983 | Japan . |
| 60-724298 | 8/1985 | Japan . |
| 61-51429 | 3/1986 | Japan . |
| 61-114945 | 6/1986 | Japan . |

*Primary Examiner*—Eugene H. Eickholt

*Attorney, Agent, or Firm*—Spencer, Frank & Schneider

[57] ABSTRACT

A method of controlling a cut-sheet feeder installed on a printer to feed a cut sheet from a sheet hopper (1) included in the cut-sheet feeder to the printing unit of the printer at a sheet feeding speed corresponding to that of the printer. The printer gives a correction signal ($S_1$) of a predetermined pulse width to the cut-sheet feeder, and then the cut-sheet feeder converts the pulse width of the correction signal into a corresponding number of pulses of a clock signal generated by its control unit (25), and obtains the difference between the number of pulses of the clock signal and a predetermined reference value to determine the deviation of the frequency of the clock signal from a reference frequency. The difference between the number of pulses of the clock signal and the reference value is added to a reference motor controlling value for driving a stepping motor (4) at a reference speed to obtain a corrected motor controlling value. When the printer gives a sheet feed command signal ($S_f$) to the cut-sheet feeder, the stepping motor is driven for rotation according to the corrected motor controlling value.

15 Claims, 6 Drawing Sheets

CUT-SHEET FEEDER CONTROL METHOD

DESCRIPTION

1. Technical Field

The present invention relates to a method of controlling the sheet feeding operation of a cut-sheet feeder mounted on an impact printer to feed a cut-sheet to the printing unit of the impact printer and, more particularly, to a method of controlling the sheet feeding operation of a cut-sheet feeder so that the cut-sheet feeder will feed a cut-sheet at a feed speed equal to the sheet feeding speed of the associated printer.

2. Background Art

Conventional impact printers are classified generally into those which prints on a continuous forms paper and those which print on a cut sheet. Some impact printers using cut sheets require a hand-feed operation. Recently, a cut-sheet feeder for automatically feeding a cut sheet to the printing unit of a printer has been used.

The cut-sheet feeder comprises a hopper containing cut sheets to be supplied to a printer, a sheet feed mechanism for feeding the cut sheets contained in the hopper one at time to the printing unit of the printer, a motor for driving the sheet feed mechanism, a power transmission mechanism for transmitting the power of the motor to the sheet feed mechanism, and a control unit which exchanges control signals with the printer to control the cut-sheet feeding operation. The cut-sheet feeder is actuated by a sheet feed command signal given thereto by the printer.

The controller of the printer gives the sheet feed command signal to the control unit of the cut-sheet feeder in setting a cut sheet in the printing unit of the printer. Upon the reception of the sheet feed command signal, the control unit actuates the motor to drive the sheet feed mechanism so that a cut sheet is delivered from the hopper. Then, the cut sheet advances along a sheet passage formed in the cut-sheet feeder, the cut sheet enters the rear portion of the printing unit of the printer obliquely downward, and the leading edge of the cut sheet reaches the circumference of the platen of the printing unit. The platen backs up the cut sheet when an impact is applied to the cut sheet for printing and rotates to feed the cut sheet. When the cut sheet is delivered to the platen, the platen rotates by winding the cut sheet around its circumference and stops when the cut sheet is settled at a predetermined position, where the printer starts printing. Thus, the cut sheet is set in place in the printing unit by the cooperative feed actions of the sheet feed mechanism of the cut-sheet feeder and the sheet feed mechanism of the printer.

Incidentally, the sheet feed speed of the printer is fixed and the platen rotates at substantially the same peripheral speed as that of the sheet. The sheet feed mechanism of the cut-sheet feeder is set so that its sheet feeding speed coincides with the sheet feeding speed of the printer. However, the sheet feed speed it is slightly variable, and hence it is possible that the sheet feeding speed of the cut-sheet feeder may deviate from that of the printer. When the sheet feed speed of the cut-sheet feeder and that of the printer do not coincide exactly with each other, the cut sheet may be slackened or tightened excessively between the sheet feeder and the platen to jam the printer with the cut sheet or to cause the cut sheet to be torn.

The variation of the sheet feed speed of the cut-sheet feeder is attributable to variation in the frequency of a clock signal for timing the sheet feed control operation of the cut-sheet feeder. The cut-sheet feeder, in general, employs a stepping motor as its power source because the stepping motor is easy to control. The shaft of the stepping motor rotates at a rotating speed corresponding to the frequency of a driving signal given to the stepping motor by the control unit of the cut-sheet feeder. This driving signal is produced by the control unit according to the clock signal.

The control unit of the cut-sheet feeder comprises a microcomputer comprising a central processing unit (hereinafter, abbreviated to "CPU"), memories, an input-output port in order to communicate with the printer (hereinafter, referred to as "I/O port"), a timer and a clock signal generator. The driving signal for driving the stepping motor is generated every time the CPU counts a predetermined number of pulses of the clock signal.

The clock signal generator employs a CR oscillator, which permits the clock signal generator to be fabricated at a reduced cost. Therefore, in some cases, the clock signal generator is unable to generate an accurate, clock signal of a predetermined standard frequency due to deviations of the resistance of the resistor and the capacitance of the capacitor from their standard values. The variation of the supply voltage and the effect of the ambient temperature also are causes of variation in the frequency of the clock signal.

Accordingly, it is an object of the present invention to provide a method of cut-sheet feeder control capable of controlling a cut-sheet feeder so that the sheet feeding speed of the cut-sheet feeder may not deviate from the sheet feeding speed of the associated printer even when the frequency of a clock signal generated by the control unit of the cut-sheet feeder deviates from a reference frequency, thereby to prevent jamming and breakage of the cut sheet.

It is another object of the present invention to provide a cut-sheet feeder control method capable of making the sheet feed speed of a cut-sheet feeder coincide with that of the platen of an associated printer by simple means.

SUMMARY OF THE INVENTION

A method of cut-sheet feeder control according to the present invention makes a printer give a correction signal of a predetermined pulse width (which corresponds to the sheet feeding speed in the printer) to a cut-sheet feeder combined with the printer, upon connection of a power source to the cut-sheet feeder and the printer, and makes a timer included in the cut-sheet feeder watch the pulse width of the correction signal by counting clock pulses.

The width of the pulses watched by the timer is compared with a predetermined reference value (which corresponds to the intended sheet feeding speed of the feeder) to obtain the difference between the value of the pulse width and the reference value. The difference is added to a value included in a timer table stored in a ROM. A corrected value thus obtained is used for correcting the period of generation of a driving pulse signal which drives stepping motor for driving a sheet feed mechanism so that the sheet feeding speed of the cut-sheet feeder coincides with that of the printer. Thus, the cut-sheet feeder and the printer operate at the same sheet feeding speed to feed a cut sheet stably to the printing position.

BEST MODE FOR CARRYING OUT THE INVENTION

Figure 1:
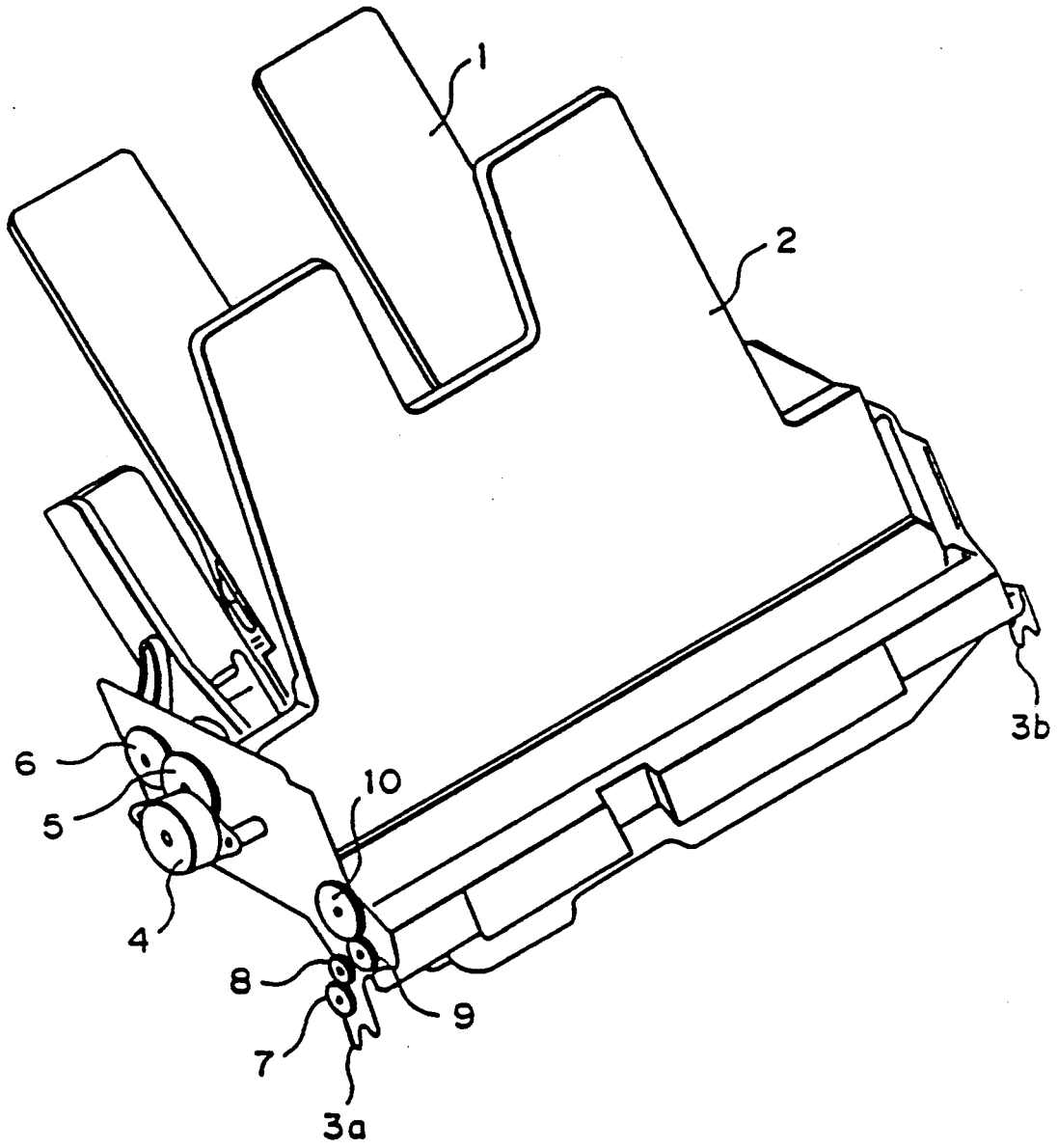
FIG. 1 is a perspective view of an exemplary cut-sheet feeder which is controlled by a cut-sheet feeder control method in accordance with the present invention.

Referring to FIG. 1 showing a cut-sheet feeder to which a cut-sheet feeder control method of the present invention is applied, the cut-sheet feeder comprises a sheet hopper 1, a stacker 2 for storing printed cut sheets discharged from a printer, legs 3*a* and 3*b* which rest on collars put on the platen shaft of a printer, a stepping motor 4 for driving a sheet feed mechanism, gears 5 and 6 operatively connecting the stepping motor 4 to a one-way clutch, not shown, and a feed roller, not shown, gears 7, 8, 9 and 10 for transmitting the rotation of the platen shaft of the printer to a stacker roller, not shown. The delivery roller is driven by the stepping motor 4 to deliver one of the cut sheets stored in the sheet hopper 1 to the printer. The stacker roller is driven by the platen shaft to stack a printed cut sheet in the stacker 2.

Figure 2:
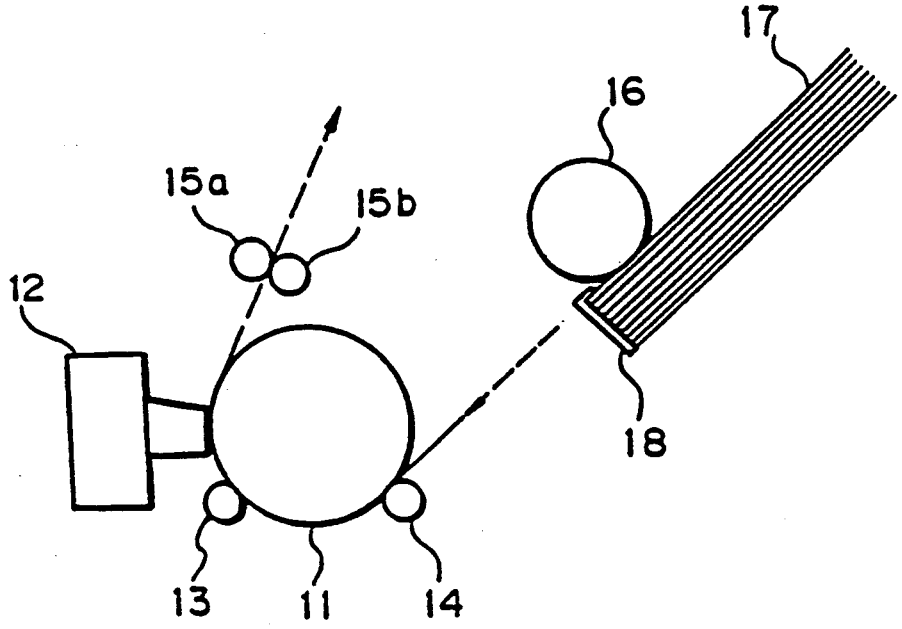
FIG. 2 is a schematic side elevation of assistance in explaining the operation of a cut-sheet feeder for feeding a cut sheet to a printer.

The sheet feeding operation of the cut-sheet feeder combined with the printer will be described hereinafter with reference to FIG. 2. In FIG. 2, there are shown a platen 11, an impact print head 12 which prints through an ink ribbon on a cut sheet, clamp rollers 13 and 14 for pressing the cut sheet against the platen 11, and delivery rollers 15*a*, 15*b* for delivering the printed cut sheet to the stacker 2, the feed roller 16 of the cut-sheet feeder for feeding the top cut sheet 17 among those stacked in a pile in the sheet hopper 1, and separating fingers 18 for separating the cut sheets 17 so that the cut sheets 17 are fed one at a time.

The cut sheets 17 of a desired size are stacked in a pile in the sheet hopper 1. The feed roller 16 is rotated to feed the top cut sheet 17 from the sheet hopper 1 to the printer. The cut sheet 17 advances along a guide passage, not shown, formed in the cut-sheet feeder and the leading edge of the cut sheet 17 is inserted between the platen 11 and the clamp roller 14. The cut sheet 17 held between the platen 11 and the clamp roller 14 is advanced along a sheet guide, not shown, which extends along the circumference of the platen 11, toward the printing position by the rotating platen 11. As the cut sheet 17 is advanced further, the cut sheet 17 is held between the platen 11 and the clamp roller 13 and is positioned at the printing position, where the top printing line on the cut sheet 17 is disposed opposite to the print head 12. Upon the arrival of the cut sheet 17 at the printing position, the platen 11 is stopped and the print head 12 starts a printing operation. The platen 11 is turned through a given angle for line spacing every time a line is completed. The printed cut sheet 17 is guided by a guide, not shown, toward the delivery rollers 15*a* and 15*b*. After the completion of printing on the cut sheet 17, the cut sheet 17 is delivered to the stacker 2 by the platen 11 and the delivery rollers 15*a* and 15*b*.

Figure 3:
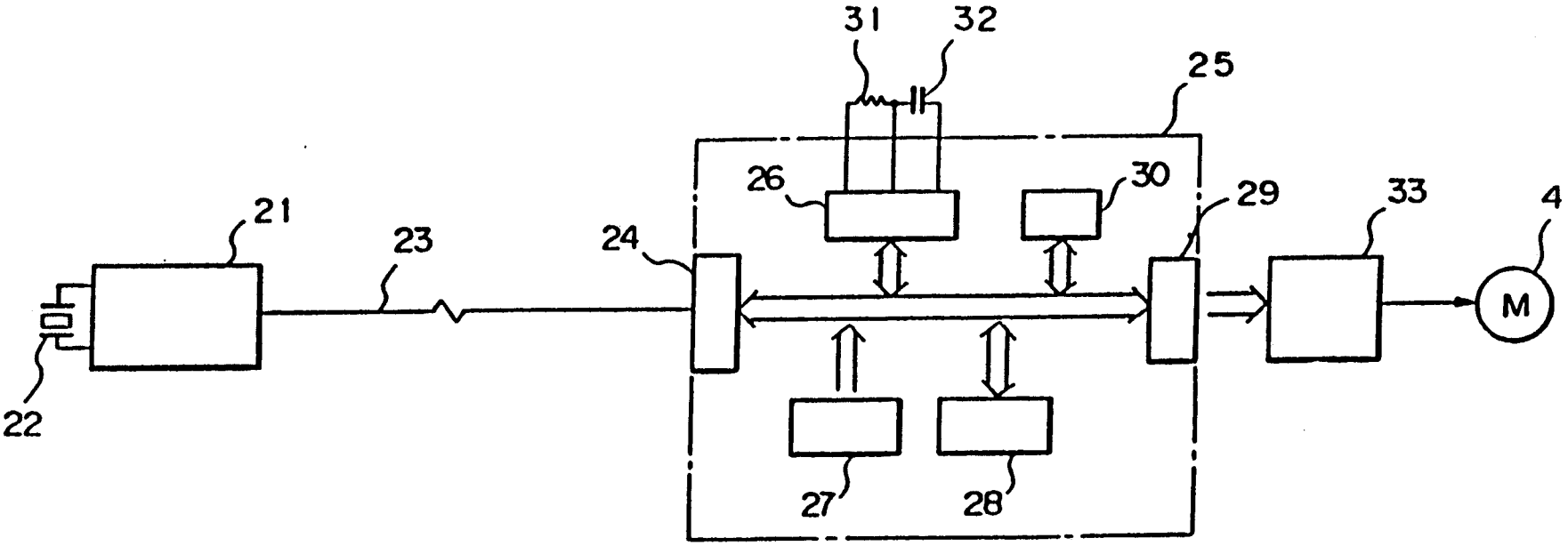
FIG. 3 is a block diagram of a control unit for carrying out a cut-sheet feeder control method according to the present invention.

FIG. 3 shows the electrical configuration of the control unit of the cut-sheet feeder. In FIG. 3, there are shown a microcontroller 21 included in the printer, a quartz oscillator 22 which generates a timing clock signal of a fixed frequency, interface signal lines 23 through which control signals are exchanged between the cut-sheet feeder and the printer, an I/O port 24, and a microcontroller 25 connected through the I/O port 24 to the interface signal lines 23. The microcontroller 25 controls the stepping motor 4 of the cut-sheet feeder.

The microcontroller 25 comprises the I/O port 24, a CPU 26, a ROM 27 storing control programs, a RAM 28 serving as an intermediate data memory, an I/O port 29 and a timer 30. The microcontroller 25 counts the pulses of a clock signal generated by a CR oscillator consisting of a resistor 31 and a capacitor 32 connected to the CPU 26, and determines timing for driving the stepping motor 4. When actuated, the stepping motor 4 drives the feed roller 16 of the cut-sheet feeder.

A driving circuit 33 is connected through the I/O port 29 to the microcontroller 25. The driving circuit 33 drives the stepping motor 4 according to control signals given thereto by the microcontroller 25.

Figure 4:
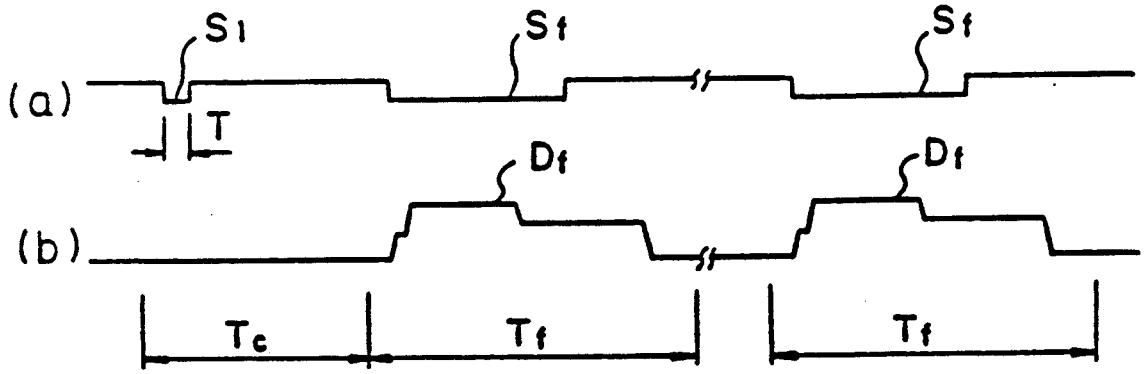
FIGS. 4(*a*) and 4(*b*) are time charts showing the timing of the control operation of the cut-sheet feeder control method according to the present invention.

Upon the connection of the printer and the cut-sheet feeder to the power source, the microcontroller 21 of the printer gives a correction signal $S_1$ of a predetermined pulse width T as shown in FIG. 4(*a*) to the microcontroller 25 of the cut-sheet feeder before sending out a sheet feed command signal. The correction signal $S_1$ is used to correct the sheet feeding speed of the cut-sheet feeder so that the sheet feeding speed of the cut-sheet feeder coincides with that of the platen 11 of the printer even if the frequency of the clock signal provided by the cut-sheet feeder differs from a reference frequency.

Figure 5:
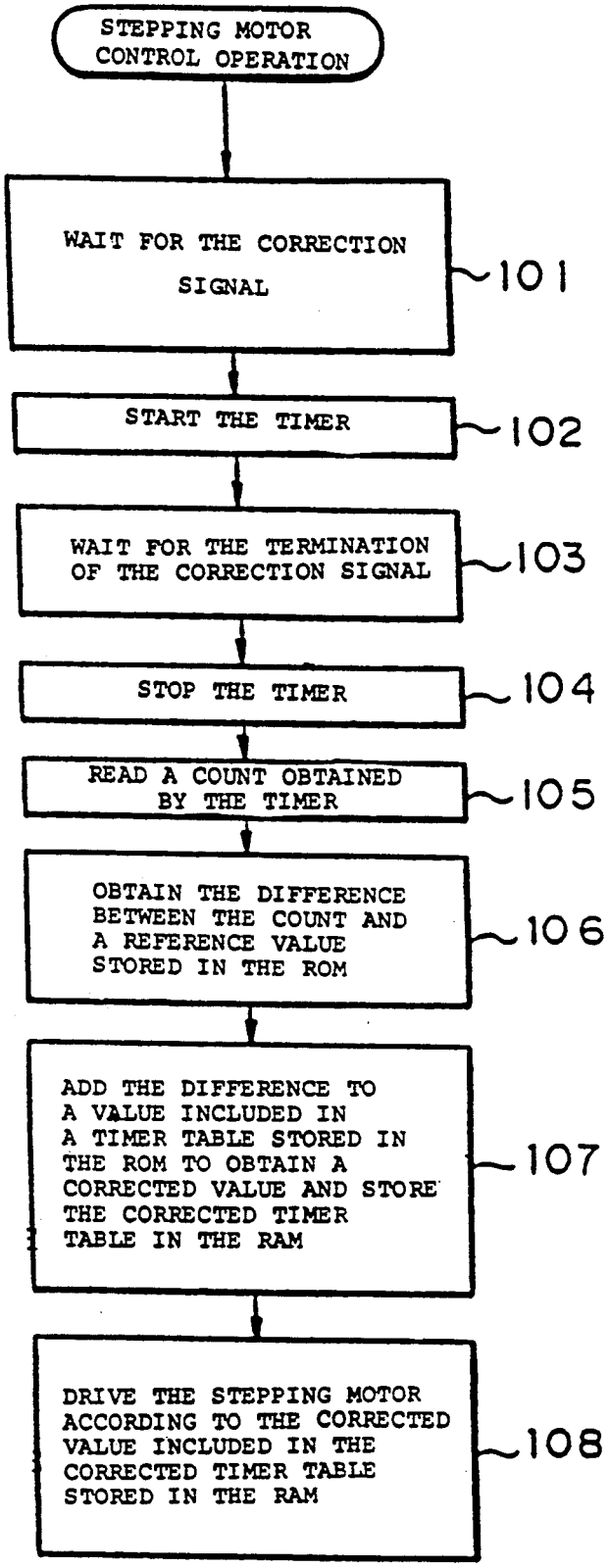
FIG. 5 is a flow chart of the control procedure of the cut-sheet feeder control method according to the present invention.

The control of the sheet feeding speed by using the correction signal $S_1$ will be described hereinafter with reference to FIG. 5.

After the cut-sheet feeder has been connected to the power source, the microcontroller 25 of the cut-sheet feeder waits for the correction signal $S_1$ in step 101. In step 102, the CPU 26 starts the timer 30 upon the reception of the correction signal $S_1$. In step 103, the timer counts the pulses of the clock signal generated by the CR oscillator consisting of the resistor 31 and the capacitor 32 until the correction signal $S_1$ terminates. In step 104, the CPU 26 stops the timer 30 upon the detection of the termination of the correction signal $S_1$. Subsequently, in step 105, the CPU 26 reads the count obtained by the timer 30. A reference count of pulses of a clock signal of a reference frequency corresponding to the pulse width of the correction signal $S_1$ is stored beforehand in the ROM 27. In step 106, the CPU 26 reads the reference count from the ROM 27 and calculates the difference between the count obtained by the timer 30 and the reference count. When the difference is zero, the frequency of the clock signal generated by the microcontroller 25 is equal to the reference frequency and the sheet feeding speed of the cut-sheet feeder need not be corrected. When the frequency of the clock signal generated by the microcontroller 25 is higher than the reference frequency, the count obtained by the timer 30 is greater than the reference count. When the frequency of the clock signal generated by the microcontroller 25 is lower than the reference frequency, the count obtained by the timer 30 is smaller than the reference count. In step 107, the CPU 26 adds the difference, represented by a positive value or a negative value, to a reference speed control value included in a reference timer table stored in the ROM 27 to produce a corrected timer table, and stores the corrected timer table in the RAM 28. The timer table correcting procedure including steps 101 to 107 is executed by the microcontroller 25 of the cut-sheet feeder in a period Tc shown in FIG. 4(*b*).

After the timer table correcting procedure has been completed, the microcontroller 21 of the printer provides a sheet feed command signal $S_f$(FIG. 4(*a*)) on the same signal line 23 that transmits the correction signal $S_1$. Upon the reception of the sheet feed command signal $S_f$, the CPU 26 applies a driving signal to the I/O port 29 in step 108 to drive the stepping motor 4 according to the corrected value included in the corrected timer table stored in the RAM 28. FIG. 4(*a*) shows control signals including the sheet feed command signal $S_f$given by the printer to the cut-sheet feeder. FIG. 4(*b*) shows the sheet feeding speed of the cut-sheet feeder, in which $D_f$indicates the sheet feeding speed of at which the cut sheet is fed in response to the sheet feed command signal $S_f$, and $T_f$indicates the period of sheet feed cycle for feeding one cut sheet.

Figure 6:
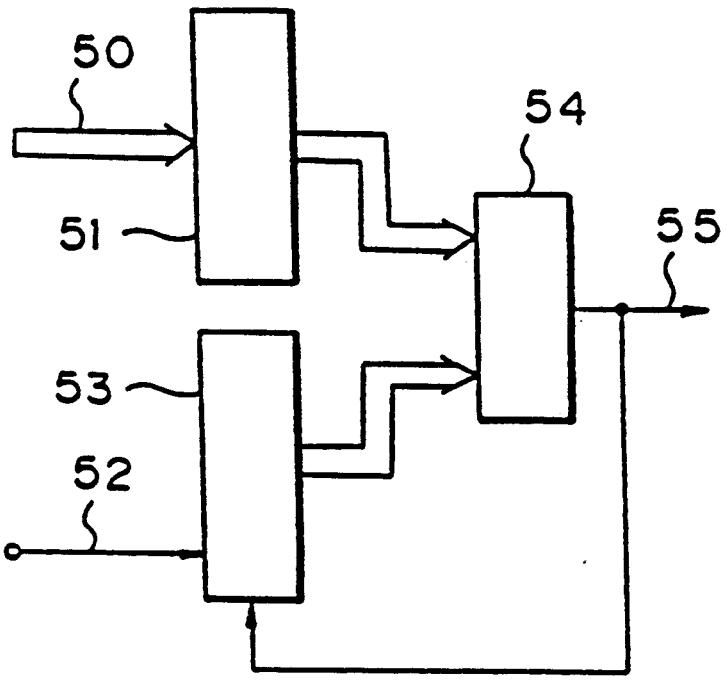
FIG. 6 is a block diagram of assistance in explaining the function of part of the procedure shown in FIG. 5 in detail.

The correction of the sheet feed speed on the basis of the corrected value included in the corrected timer table will be described further with reference to FIG. 6. A corrected value 50 included in the corrected timer table is read from the RAM 28 and is latched by a temporary memory 51. The pulses of a clock signal 52 is counted by a counter 53. A comparator 54 compares the count of pulses obtained by the counter 53 with the corrected value included in the corrected timer table temporarily stored in the temporary memory 51. When the count coincides with the corrected value, a driving command signal 55 for driving the stepping motor 4 is provided and, at the same time, the counter 53 is cleared to zero by the driving command signal 55 and starts counting the pulses of the clock signal. Thus, the time duration for the counter 53 to count up to the corrected speed control value 50 determines the rate at which the driving command signal 55 drives the motor 4.

Accordingly, the greater the corrected value 50 included in the corrected timer table, the longer is the period of repetition of the driving command signal 55 for driving the stepping motor 4, and vice versa. As is generally known, in controlling the operation of a stepping motor, the phase of excitation is changed every time a driving command signal is given thereto to make the stepping motor rotate through a given angular step. Therefore, the rotational speed of the stepping motor 4 decreases as the period of repetition of the driving command signal increases, and hence the sheet feeding speed of the cut-sheet feeder decreases, and vice versa.

As is apparent from the foregoing description, according to the present invention, the period of repetition of the driving command signal for driving the stepping motor 4 is increased when the frequency of the clock signal generated by the microcontroller 25 of the cut-sheet feeder is higher than the reference frequency and the period of repetition of the driving command signal is decreased when the frequency of the clock signal is lower than the reference frequency, thereby to correct the sheet feeding speed of the cut-sheet feeder so that the same coincides with the sheet feed speed of the printer.

Figure 7:
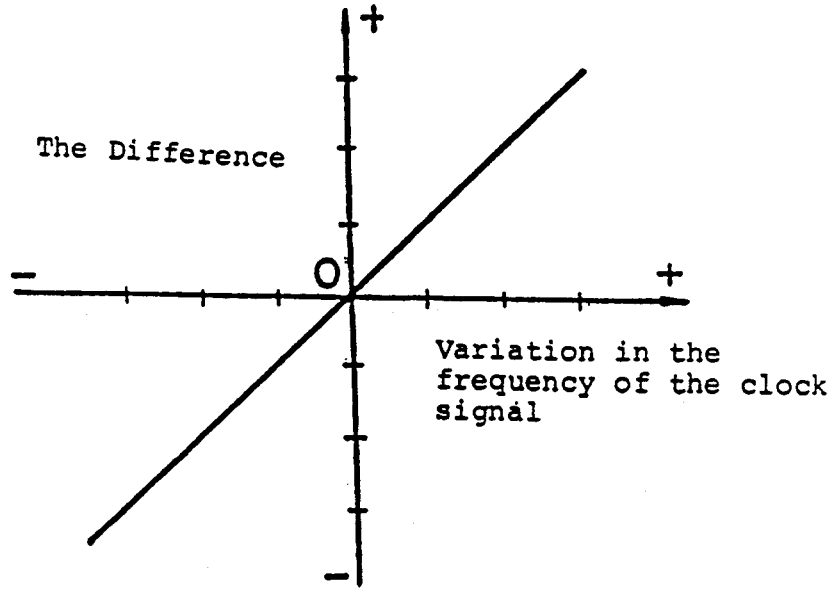
FIG. 7 is a graph showing the variation of the difference between the count of pulses obtained by a timer and a reference value with the frequency of a clock signal.
Figure 8:
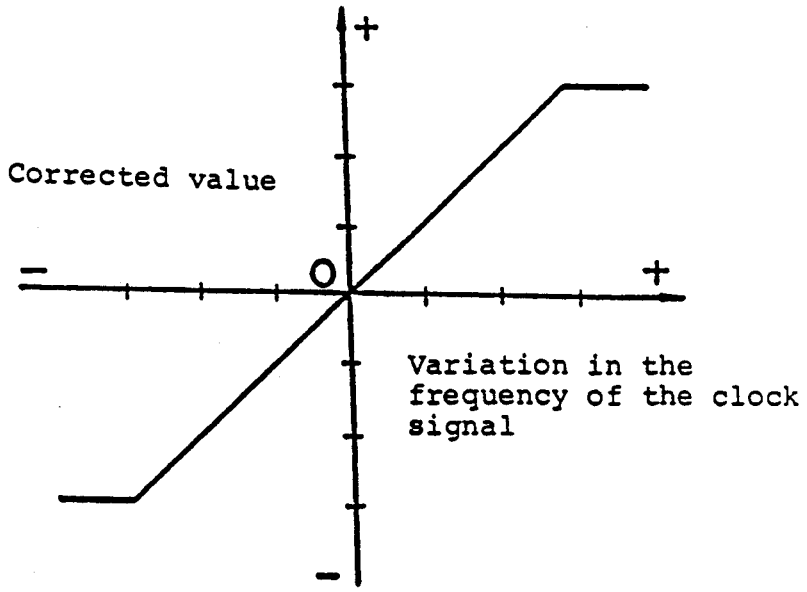
FIG. 8 is a graph showing the variation of correction for correcting a timer table with the frequency of the clock signal.
Figure 9:
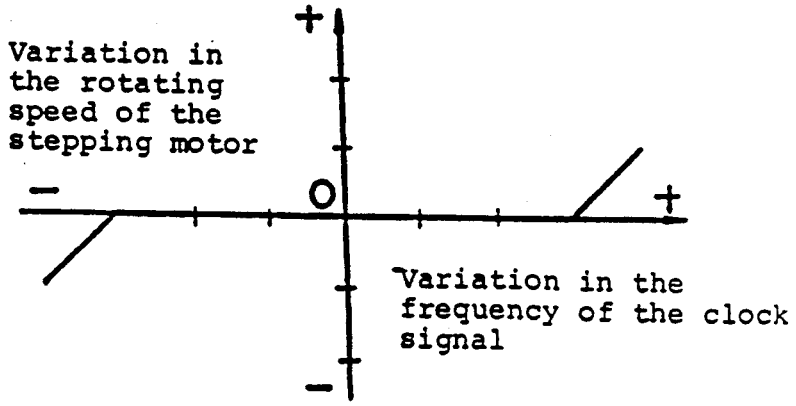
FIG. 9 is a graph showing the variation of the rotating speed of a stepping motor with the frequency of the clock signal.

FIG. 7 is a graph showing the variation of the difference between the count of pulses obtained by the timer and the reference value with the frequency of the clock signal, and FIG. 8 is a graph showing the correction for correcting the timer table with the frequency of the clock signal. The maximum for the correction is limited to a value that will not make the value included in the reference timer table overflow. FIG. 9 is a graph showing the variation of the rotating speed of the stepping motor 4 with the frequency of the clock signal. As is obvious from FIG. 9, the variation of the rotating speed of the stepping motor 4 is zero for the variation of the frequency of the clock signal within a given narrow range.

The present invention is not limited in its application to the foregoing embodiment, and many changes and variations are possible therein without departing from the scope and spirit thereof.

CAPABILITY OF EXPLOITATION IN INDUSTRY

As is apparent from the foregoing description, the present invention enables the cut-sheet feeder to feeding a cut sheet stably at a sheet feed speed corresponding to that of the printer, so that the cut sheet can be fed to the printing unit of the printer without jamming the printer and without being torn in automatically feeding the cut sheet by the cut-sheet feeder to the printer. Thus, the present invention is advantageously applicable to the control of a cut-sheet feeder installed on a printer.

We claim:

1. A method of controlling a cut-sheet feeder coupled to a printer, the feeder having a cut-sheet feed mechanism and a motor for driving the feed mechanism to feed cut sheets to the printer at a predetermined feeding speed, the method comprising the steps of:

a. storing a reference control value corresponding to the predetermined feeding speed, and a reference pulse count in a memory;

b. generating clock pulses in the feeder;

c. sending a correction pulse of a predetermined width from the printer to the feeder during said step b;

d. counting the clock pulses generated during a time interval corresponding to the predetermined width to obtain a first pulse count;

e. determining the difference between the reference pulse count and the first pulse count;

f. adding the difference determined in said step e to the reference control value to obtain a motor controlling value; and g. controlling the motor as a function of the motor controlling value obtained in said step f to drive the feed mechanism to feed the cut sheets to the printer at the predetermined feeding speed.

2. A method according to claim 1, further comprising the steps of:

h. connecting the feeder to a power source, and i. transmitting over a single signal line after said step c a sheet feed command signal which commands the feeder to feed a cut sheet to the printer, said step c being performed over the single signal line after said step h.

3. A method according to claim 1, wherein the motor is a stepping motor and said step g includes the step of controlling a rotating speed of the stepping motor as a function of the motor controlling value.

4. A method according to claim 3, wherein said step g further comprises the steps of:

transmitting to the feeder a sheet feed command signal, repetitively counting the clock pulses in the feeder up to the motor controlling value upon receipt by the feeder of the sheet feed command signal, providing a stepping motor driving command signal each time the counting of the clock pulses reaches the motor controlling value; and turning the stepping motor through a predetermined angular step in response to each stepping motor driving command signal.

5. A method according to claim 1, wherein said step g includes the steps of:

j. counting the clock pulses up to a second pulse count equal to the motor controlling value, and k. controlling the motor as a function of a duration of time for the count in said step j to reach the second pulse count to drive the feed mechanism to feed the cut sheets to the printer at the predetermined feeding speed.

6. A method according to claim 5, further comprising the step of:

l. feeding the cut sheets in the printer to an initial print position at a feeding speed which is equal to the predetermined feeding speed.

7. A method according to claim 1, further comprising the step of:

m. feeding the cut sheets in the printer to an initial print position at a feeding speed which is equal to the predetermined feeding speed.

8. A method according to claim 7, wherein the predetermined pulse width corresponds to the feeding speed at which the cut sheets are fed in the printer in said step m.

9. A method according to claim 1, wherein said step b includes the step of using a CR oscillator formed with a capacitor and a resistor to produce the clock pulses.

10. A method according to claim 9, wherein said step c includes the step of determining the width of the correction pulse using a timing clock signal output by a crystal oscillator in the printer.

11. A method according to claim 9, further comprising the step of controlling a feed mechanism in the printer using an output signal of the crystal oscillator to feed the cut sheets in the printer to an initial print position at a feeding speed which is equal to the predetermined feeding speed.

12. A method according to claim 1, wherein the printer has an oscillator which generates a timing clock signal of a fixed frequency, said step c including the step of determining the width of the correction pulse with the timing clock signal, further comprising the step of feeding the cut sheets in the printer to an initial print position at a feeding speed which is determined by the timing clock signal.

13. A method according to claim 12, wherein the feeding speed in the printer is equal to the predetermined feeding speed.

14. A method according to claim 12, wherein said step b includes the step of using a CR oscillator formed with a capacitor and a resistor to produce the clock pulses.

15. A method according to claim 14, wherein the oscillator of the printer is a crystal oscillator.

* * * * *